US011001483B2

(12) United States Patent
Zheng

(10) Patent No.: US 11,001,483 B2
(45) Date of Patent: May 11, 2021

(54) WINCH

(71) Applicant: NINGBO CHIMA WINCH CO., LTD., Ningbo (CN)

(72) Inventor: Mingkui Zheng, Ningbo (CN)

(73) Assignee: NINGBO CHIMA WINCH CO., LTD., Ningbo (CN)

( * ) Notice: Subject to any disclaimer, the term of this patent is extended or adjusted under 35 U.S.C. 154(b) by 569 days.

(21) Appl. No.: 15/874,900

(22) Filed: Jan. 19, 2018

(65) Prior Publication Data

US 2018/0201488 A1 Jul. 19, 2018

(30) Foreign Application Priority Data

Jan. 19, 2017 (CN) ..... 201710038798.2
Nov. 7, 2017 (CN) ..... 201711083454.X

(51) Int. Cl.
*B66D 1/48* (2006.01)
*B66D 1/12* (2006.01)
*B66D 1/28* (2006.01)

(52) U.S. Cl.
CPC ..... *B66D 1/485* (2013.01); *B66D 1/12* (2013.01); *B66D 1/28* (2013.01)

(58) Field of Classification Search
CPC ... B66D 1/12; B66D 1/28; B66D 1/40; B66D 1/485
See application file for complete search history.

(56) References Cited

U.S. PATENT DOCUMENTS

| | | | | |
|---|---|---|---|---|
| 9,266,702 | B2 * | 2/2016 | Fretz | B66D 1/02 |
| 9,902,597 | B2 * | 2/2018 | Huang | B66D 1/00 |
| 10,112,808 | B2 * | 10/2018 | Fretz | B66D 1/22 |
| 10,322,916 | B2 * | 6/2019 | Cui | B66C 23/708 |
| 10,457,531 | B2 * | 10/2019 | Zheng | B66D 1/58 |
| 10,625,995 | B2 * | 4/2020 | Vaughn | B66D 1/16 |
| 10,662,036 | B2 * | 5/2020 | Fretz | B66D 1/40 |
| 10,662,037 | B2 * | 5/2020 | Cui | B66D 1/12 |
| 2007/0221898 | A1 * | 9/2007 | Giacomini | B66D 1/225 254/323 |
| 2008/0001132 | A1 * | 1/2008 | Huang | B66D 1/12 254/362 |
| 2014/0001427 | A1 * | 1/2014 | Fretz | B66D 1/02 254/342 |
| 2014/0257631 | A1 * | 9/2014 | Heravi | G08C 17/02 701/36 |
| 2018/0175713 | A1 * | 6/2018 | Fretz | H02K 7/116 |
| 2019/0225466 | A1 * | 7/2019 | Carignan | B66D 1/12 |

(Continued)

FOREIGN PATENT DOCUMENTS

CN 103508344 A 1/2014

*Primary Examiner* — Michael E Gallion
(74) *Attorney, Agent, or Firm* — Bayramoglu Law Offices LLC

(57) ABSTRACT

A winch including a motor, a first reel holder, a second reel holder, a connecting structure used for connecting the first reel holder and the second reel holder, a rotatable reel, and a deceleration unit. The motor is connected to the first reel holder. The deceleration unit is connected to second reel holder. The winch further includes a housing, which is connected to the first reel holder. The motor is located in the housing. The housing is provided with an in-and-out structure used for an electrical connection to a power supply structure of the motor.

14 Claims, 7 Drawing Sheets

(56) References Cited

U.S. PATENT DOCUMENTS

| | | | | |
|---|---|---|---|---|
| 2019/0292026 | A1* | 9/2019 | Felps | B66D 1/485 |
| 2019/0382247 | A1* | 12/2019 | Cui | B66D 1/28 |
| 2020/0131010 | A1* | 4/2020 | Kukula | B66D 3/26 |

* cited by examiner

WINCH

CROSS REFERENCE TO RELATED APPLICATIONS

This application is based upon and claims priority to Chinese Patent Application No. 201710038798.2, filed on Jan. 19, 2017, and Chinese Patent Application No. 201711083454.X, filed on Nov. 7, 2017, the entire content of which is incorporated herein by reference.

TECHNICAL FILED

The present invention relates to a technical field of the traction device, particularly to a winch.

BACKGROUND

The Chinese patent with the publication number CN103508344A discloses a windlass, namely, a winch. The left and right sides of the winch structure are symmetrical or substantially symmetrical. In order to make it symmetrical or substantially symmetrical, the solution is to eliminate the impact of the traditional winch with respect to the outer shell of independent motor in terms of the whole shape of the winch. For this purpose, the invention has redesigned the motor and the first reel holder, dividing the motor into two parts, i.e., the motor outer shell including a motor case and the first reel holder attached to the motor housing for closing the end of the motor housing. Obviously, the first reel holder becomes part of the construction of the motor housing. In this way, it has some advantages and disadvantages. For example, significant changes should be made to the motor and the first reel holder, which obviously adds manufacturing difficulty. Moreover, many original parts cannot be used in this winch design, causing the issue of versatility of parts and components, as well as the waste of the original productivity, and thus in creasing the cost.

For making the structure symmetric, the above-mentioned invention redesigns the electrical connection between the control unit (control box) and the motor, i.e., the motor includes an armature terminal and an electric field terminal attached to the first reel holder. The control unit is electrically connected to the armature terminal and the electric field terminal of the motor through a bus bar (copper sheet). The control unit comprises a cover plate covering the bus bar to form the preferred embodiment shown in FIG. 1 of this invention disclosure. FIG. 1 is an example of an integration of each independent claim of the invention disclosure. The direct benefit of such improvement is that the design of winch shape is facilitated. In addition, the simple connection between the control unit and the motor is realized. Due to the cover plate (i.e., cover), the bus bar is not exposed. Meanwhile, this also has some disadvantages. That is, it is inconvenient to use the control unit separately. Moreover, the solution can only be achieved based on the improvements of the motor and the first reel holder of the above-mentioned invention disclosure. That is, the motor and the first reel holder should be modified at the same time. Compared to the traditional winch, significant modifications are required.

SUMMARY

The technical problem to be solved by the present invention is to overcome the defects of the prior art by providing a winch and designing a new technical route to realize the electrical connection between the control unit and the motor. In the technical route, the motor and the first reel holder should not require significant modifications.

In order to solve the above technical problem, the present invention provides a winch comprising a motor, a control unit, a first reel holder, a second reel holder, a connection structure for connecting the first reel holder and the second reel holder, a rotatable reel, and a deceleration unit. The motor is connected to the first reel holder. The deceleration unit is connected to the second reel holder. The control unit comprises a contactor. The winch further comprises a housing which forms a chamber with the first reel holder. The motor is located in the chamber. The housing is provided with an in-and-out structure for electrical connection of the power supply structure of the motor. The power supply structure includes a first electrical connection terminal for electrically connecting to the contactor. The control unit is adjacent to the first electrical connection terminal, or the control unit extends toward the first electrical connection terminal to cover the first electrical connection terminal. The first electrical connection terminal and the contactor are electrically connected by the conductor.

Compared with the prior art, the present invention has the following advantages: With the housing and the related structure, the motor can directly use the prior art. The requirement for the motor is that the first electrical connection terminal is adjacent and as close as possible to the control unit, so that the modification to the motor is little. Then, the motor is combined with the control unit, so that the electrical connection layout between the control unit and the motor can be achieved, which is similar to the prior art, facilitating the winch shape design. The housing production and installation are simple. Further, the modification of the first reel holder can little. For example, a connecting screw hole is drilled in an existing first reel holder. The connecting screw hole is used to connect the connecting bolt on the housing, so that the existing first reel holder can be used directly. Thus, the manufacturing difficulty can be significantly reduced. Many original parts can be used in the winch of this design. The versatility of the parts is improved. The original productivity can be utilized, and the cost is controlled very well. With the housing, the shape of the housing can be made into a similar shape to the housing of the deceleration unit, so as to achieve the symmetrical structure, which is similar to the prior art. In addition, with the housing, the motor can be protected by the housing to a certain extent, thus strengthening the protection of the motor. In summary, as a new technical route, taking all aspects into account, the present technical route is more balanced.

Preferably, a transition piece is arranged on the circuit between the first electrical connection terminal and the contactor. The first electrical connection terminal is electrically connected to the transition piece via the first conductor. The transition piece is electrically connected to the contactor via the second conductor. In this way, on one hand, the electrical connection between the first electrical connection terminal and the contactor is convenient, i.e., facilitating the assembly. On the other hand, it is easy to use the control unit and the winch body separately.

Preferably, the control unit includes a mounting plate. One end of the mounting plate extends outward. A portion extending outward is adjacent to the first electrical connection terminal. A transition piece is mounted on the extended portion. The first electrical connection terminal and the transitional piece are electrically connected via the first conductor. The transitional piece and the contactor are electrically connected via the second conductor. In this way, when the control unit needs to be separated from the winch body, only the first conductor needs to be replaced by a cable, without disassembling the electrical connection structure of the control unit housing or the contactor end. In summary, the disassembly is more convenient and simpler.

Preferably, a cover is also provided for covering the exposed portions of the first electric connection terminal, the first conductor, the transition piece and the second conductor, for protection. In addition, the shape of the cover can be designed to match the overall shape of the winch, facilitating the design of the overall shape of the winch.

Preferably, the housing is a cylindrical housing with one end closed and the other end open. The end surface of the open end is attached to the side surface of the first reel holder which is on one side of the motor. The open end is provided with a first U-shaped opening. The first electrical connection terminal is exposed through the first U-shaped opening. The conductor extends into the first U-shaped opening and is electrically connected to the first electrical connection terminal. In this way, the assembly of the related structure is facilitated, and the space for operation is relatively abundant.

Preferably, a reinforcing rib is arranged along the circumferential direction of the housing. A mounting hole is provided at the position where the first reel holder and one end of the reinforcing rib are attached. The mounting hole is used for connecting the connection structure. After the housing is attached to the first reel holder, the mounting hole is covered by one end of the reinforcing rib. In this way, while the strength of the housing is improved, the design of the appearance of the winch is facilitated, serving two purposes.

Preferably, the first electrical connection terminal comprises three terminals. One terminal is a carbon brush positive terminal, and the other two terminals are a stator positive terminal and a stator negative terminal respectively. The stator positive terminal, the carbon brush positive terminal, and the stator negative terminal are sequentially distributed along the circumferential direction of the motor. The carbon brush positive terminal is axially offset so that the three terminals are distributed into a triangle. In this way, it is convenient to perform the layout of the three terminals of the motor. In addition, since it is necessary to provide holes on the housing of the motor to install the terminals, the distribution along the triangle can make the spacing between adjacent holes maintain a certain distance, so as to ensure the strength of the hole. Otherwise, if the three terminals are circumferentially linearly distributed, the distance between positive and negative terminals of the stator will be too large, which is adverse for a compact structure. Moreover, the triangular distribution is also good for the strength and stability of wiring to some degree.

Preferably, the power supply structure includes a carbon brush negative terminal. A second U-shaped opening is arranged at the back of the housing. The conductor of the carbon brush negative terminal which is electrically connected to the negative terminal of the power supply goes in and out through the second U-shaped opening. In this way, after the winch is loaded, the carbon brush negative terminal and related structures will be hidden, showing the appearance of the winch easily.

Preferably, the connection structure is located above the rotatable reel. The control unit is located above the connection structure and connected to the connection structure. The first electrical connection terminal is located on the same side as the control unit. In this way, the structure is compact, and the disassembly and assembly are convenient.

Preferably, the present invention further comprises a decorative shell, which is connected to the deceleration unit to form an integral shape. The integral shape is bilaterally symmetrical or substantially bilaterally symmetrical with respect to the shape of the housing. In this way, on one hand, it is beneficial to the appearance to be bilaterally symmetrical. On the other hand, significant modifications to the deceleration unit can be avoided.

Figure 1:
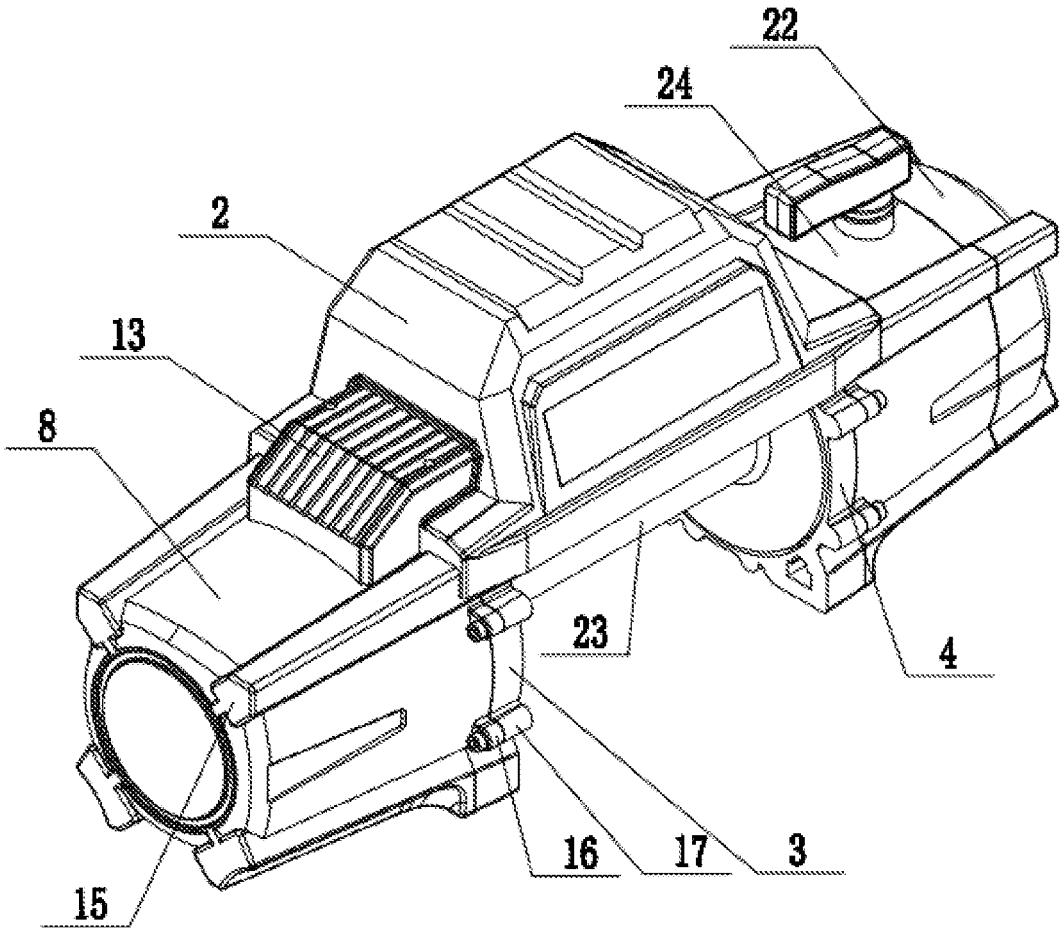
FIG. 1 is a structural schematic view of the winch.
Figure 2:
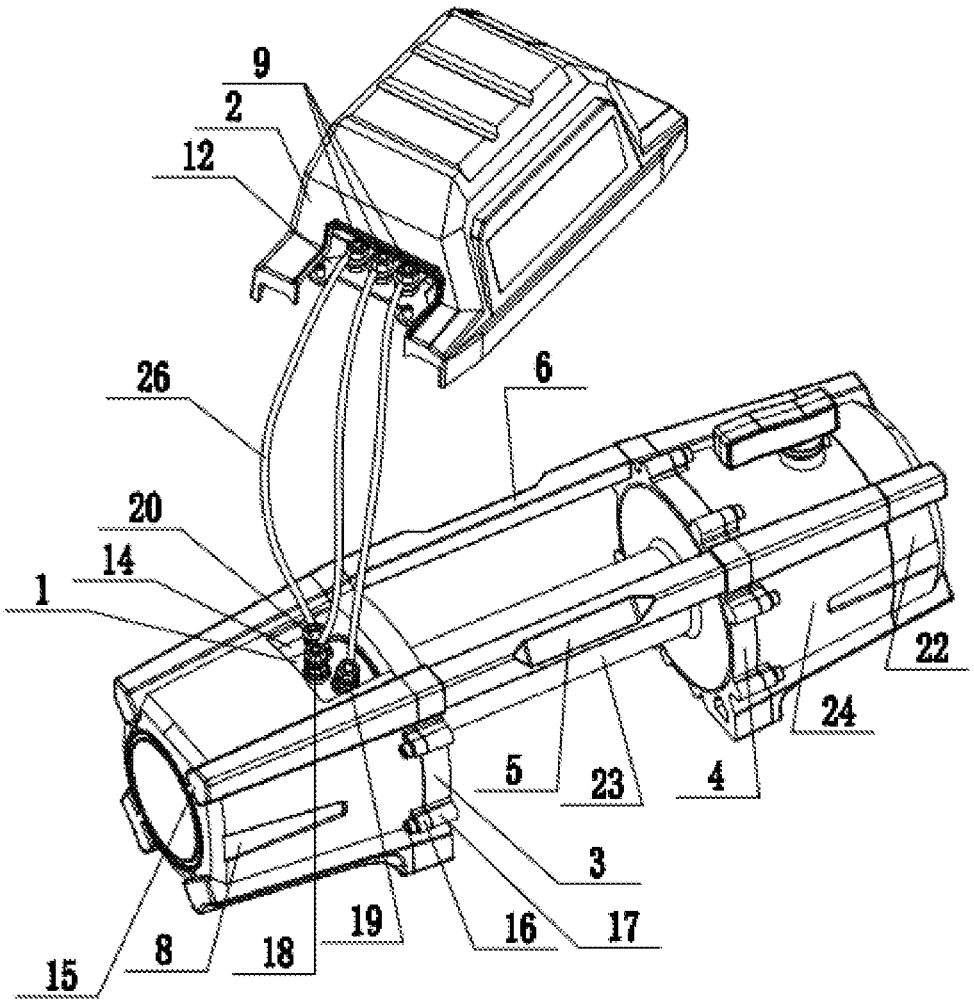
FIG. 2 is a structural schematic view showing the situation where the control unit and the winch body are used separately.
Figure 3:
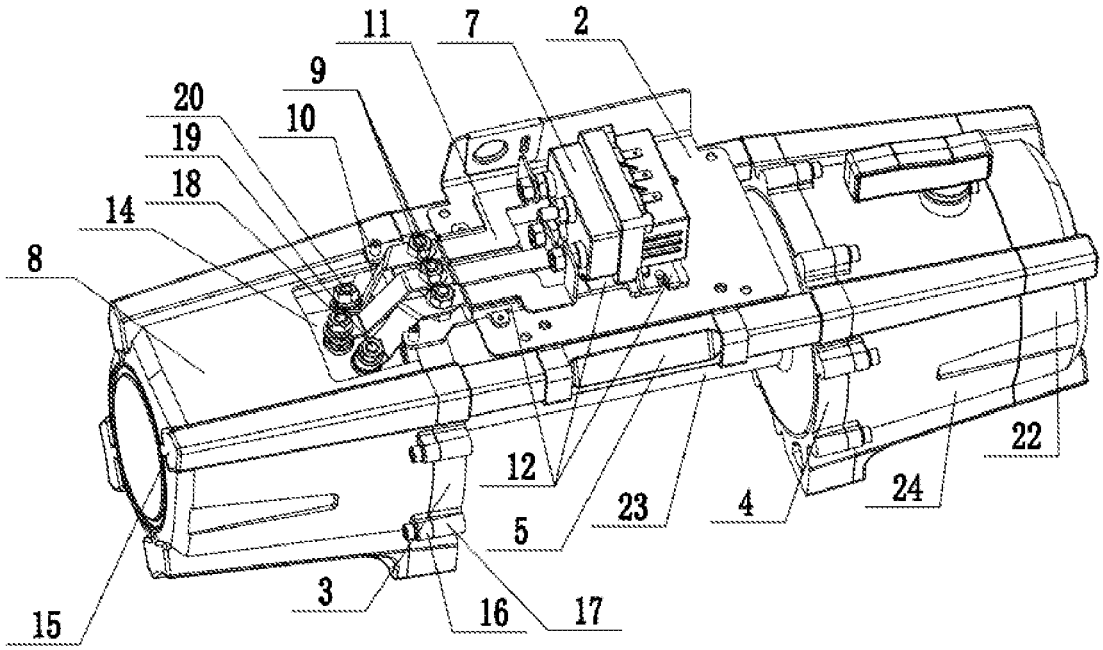
FIG. 3 is a structural schematic view after the housing of the control unit is removed.
Figure 4:
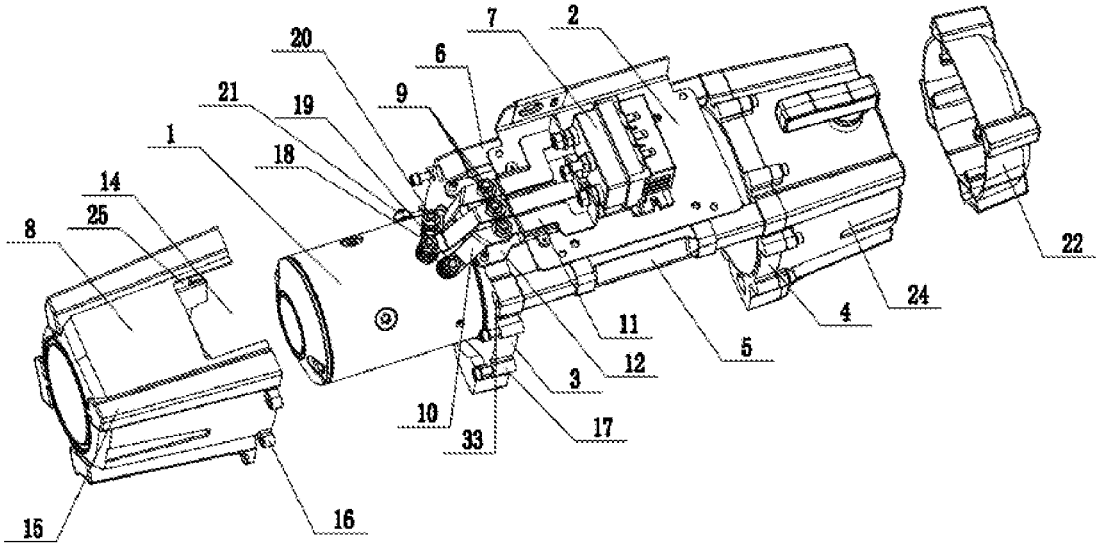
FIG. 4 is a structural schematic view after the housing and decorative shell axis are separated.

In the drawings: 1. motor; 2. control unit; 3. first reel holder; 4. second reel holder; 5. first connecting rod; 6. second connecting rod; 7. contactor; 8. housing; 9. transition piece; 10. first conductor; 11. second conductor; 12. mounting plate; 13. cover; 14. first U-shaped opening; 15. reinforcing rib, 16. first connecting position; 17. second connecting position; 18. carbon brush positive terminal; 19. stator positive terminal; 20. stator negative terminal; 21. carbon brush negative terminal; 22. decorative shell; 23. rotatable reel; 24. deceleration unit; 25. second U-shaped opening; 26. cable; 27. stator; 28. rotor; 29. carbon brush holder; 30. motor housing; 31. motor back cover; 32. connecting bolt; 33. mounting hole.

DETAILED DESCRIPTION OF THE EMBODIMENT

The following is a detailed description of the present invention:

The winch of the present invention comprises motor 1, control unit 2, first reel holder 3, second reel holder 4, connecting structure for connecting the first reel holder 3 and the second reel holder 4, rotatable reel 23 and deceleration unit 24. The motor 1 is connected to the first reel holder 3. The deceleration unit 24 is connected to the second drum holder 4. The control unit 2 includes a contactor 7 and further comprises a housing 8. The housing 8 and the first reel holder 3 form a chamber, in which the motor 1 is located. The housing 8 is provided with an in-and-out structure for the electrical connection of the power supply structure of the motor 1. The power supply structure comprises a first electrical connection terminal for electrically connecting to the contactor 7. The control unit 2 is adjacent to the first electrical connection terminal, or the control unit 2 extends toward the first electrical connection terminal to cover the first electrical connection terminal. The first electrical connection terminal and the contactor 7 are electrically connected via a conductor. In this embodiment, the control unit 2 is adjacent to the first electrical connection terminal. Then, the first electrical connection terminal is covered by the detachably connected cover 13. If the cover 13 is not separately provided, the housing of the control unit 2 provides the coverage provided by the cover 13, where the control unit 2 extends to a first electrical connection terminal to cover the first electrical connection terminal.

A transition piece 9 is provided between the first electrical connection terminal and the contactor 7. The first electrical connection terminal and the transition piece 9 are electrically connected via the first conductor 10. The transition piece 9 and the contactor 7 are electrically connected via the second conductor 11.

The control unit 2 includes a mounting plate 12. One end of the mounting plate 12 extends outward. The portion extending outward is adjacent to the first electrical connection terminal. The transition part 9 is mounted on the portion extending outward. The first electrical connection terminal and the transition piece 9 are electrically connected via the first conductor 10. The transition piece 9 and the contactor 7 are electrically connected via the second conductor 11.

The first conductor 10, and the second conductor 11 use bus bar, i.e., copper connector. Certainly, the truncated cable can also be used, as long as the safe electricity requirement is met.

The transition piece 9 has three terminals mounted on the mounting plate 12.

The mounting plate 12 is an integrally injection molded part of the insulating polymer material, such as ABS plastic. The contactor 7 is also mounted on the upper surface of the mounting plate 12 to increase the supporting strength and improve the insulation.

The control unit 2 shown in the drawings is a simplified version, and can also be installed with other components to realize complicated functions, such as a remote control unit and the like.

With the control unit 2 separated from the winch body, the first conductor 10 is replaced by a cable 26, which is very convenient to assemble and disassemble. The second conductor 11 is exposed less. The transition piece 9 has a good support and insulation for the mounting plate 12, so that the cable 26 is securely connected, and a certain insulation at the connection position can be ensured, without affecting the electrical connection structure of the contactor 7. The housing of the control unit 2 is not required to be removed.

Further, the present invention includes a cover 13. The cover 13 is used to cover the exposed portions of the first electrical connection terminal, the first conductor 10, the transition piece 9, and the second conductor 11. In this embodiment, the cover 13 covers the portion between the control unit 2 and the first U Shaped opening 14. At the same time, the cover 13 is shaped in such a way to match the winch shape, so that the appearance of the entire winch is more coordinated. A sealing pad can be added inside the cover 13 to make it waterproof and dustproof, so as to achieve higher use requirements.

The housing 8 is a cylindrical housing with one end closed and the other end open. The end surface of the open end is attached to the side surface of the first reel holder 3 located on one side of the motor 1. The open end is provided with a first U-shaped opening 14. The first electrical terminal is exposed through the first U-shaped opening 14. The conductor extends into the first U-shaped opening 14 and is electrically connected to the first electrical connection terminal.

The housing 8 is provided with reinforcing ribs 15 in the circumferential direction. A mounting hole 33 is provided at a position where the first reel holder 3 and one end of the reinforcing ribs 15 are attached to each other. The mounting hole 33 is inserted into a connecting piece to connect to the connecting structure. After the housing 8 is attached to the first reel holder 3, the mounting hole 33 is covered by one end of the reinforcing rib 15. In this embodiment, bolts are used as the connecting piece.

The housing 8 is circumferentially provided with a first connecting portion 16. A second connecting portion 17 which corresponds to the first connecting portion 16 is circumferentially provided on the first reel holder 3. The first connecting portion 16 and the second connecting portion 17 are connected by bolts.

The first electrical connection terminal comprises three terminals, wherein one is a carbon brush positive terminal 18, and the other two are a stator positive terminal and a stator negative terminal respectively. The stator positive terminal 19, the carbon brush positive terminal 18, and the stator negative terminal 20 are sequentially distributed along the circumferential direction of the motor 1. The carbon brush positive terminal 18 is axially offset so that three terminals are distributed along a triangle. Alternatively, the stator negative terminal 20, the carbon brush positive terminal 18, and the stator positive terminal 19 can be sequentially distributed along the circumferential direction of the motor 1.

Figure 5:
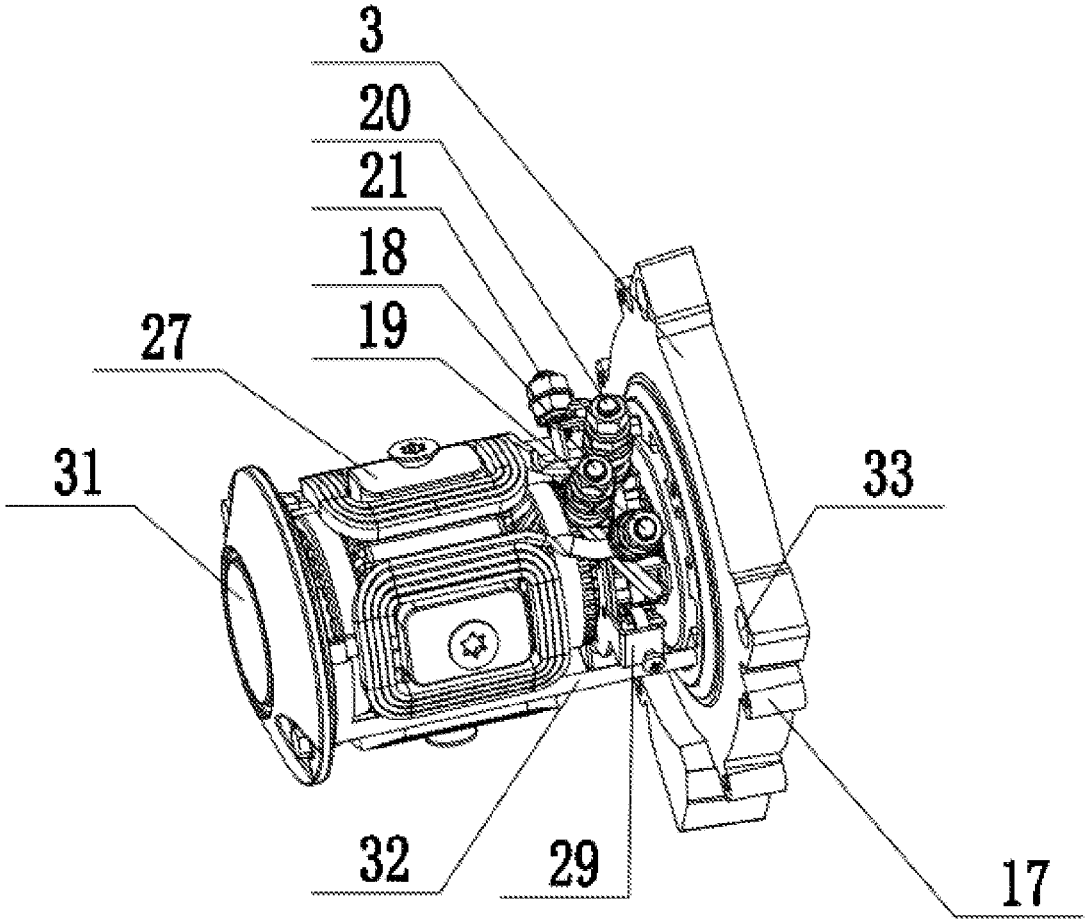
FIG. 5 is a structural schematic view of the motor after the motor housing is removed.
Figure 6:
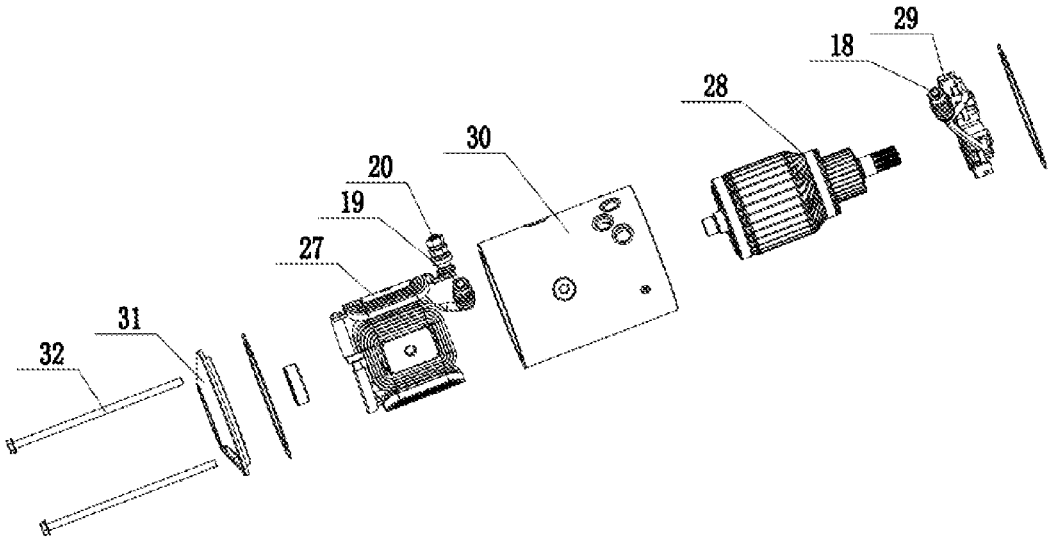
FIG. 6 is an exploded structural schematic view of the motor.
Figure 7:
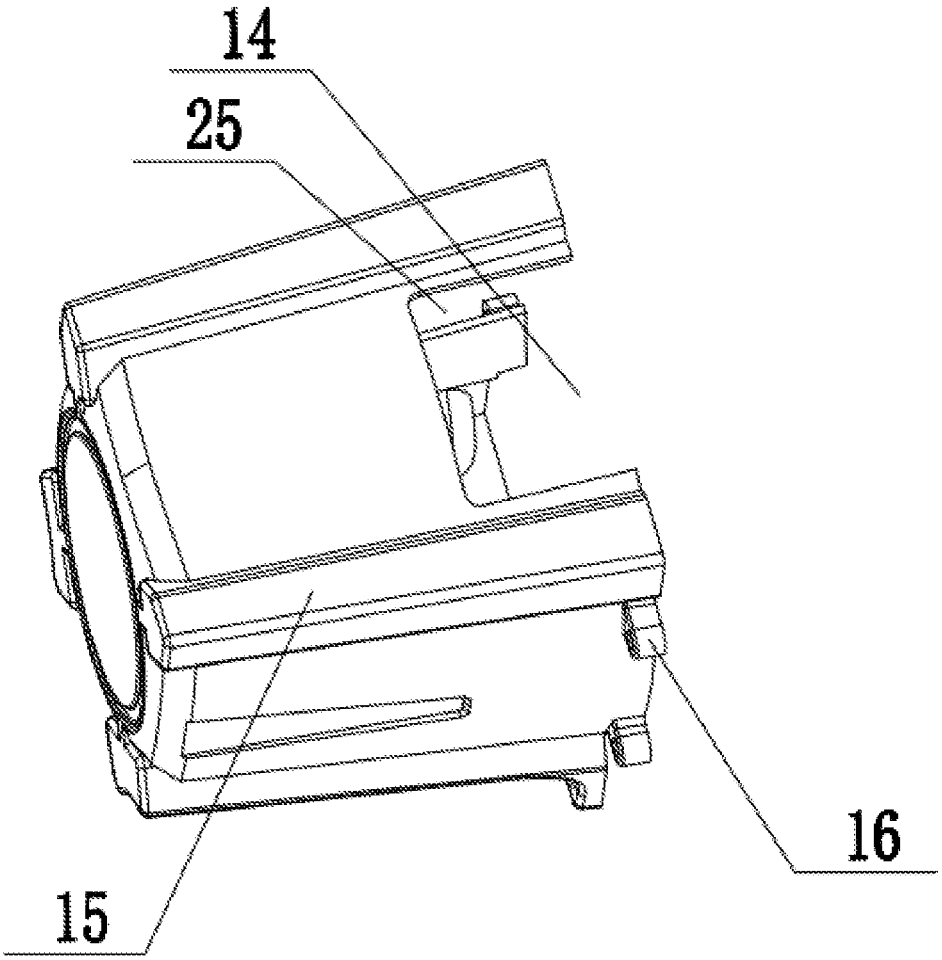
FIG. 7 is a structural schematic view of the housing.

The power supply structure comprises a carbon brush negative terminal 21. A second U-shaped opening 25 provided in the back of the cover 8. A conductor of the carbon brush negative electrode terminal 21 electrically connected to the negative pole of the power supply goes in and out through the second U-shaped opening 25. FIG. 5 shows the carbon brush negative terminal 21 directly.

The structure of the motor 1 is mainly based on the prior art and includes a stator 27, a rotor 28, a carbon brush holder 29, a motor housing 30, a motor back cover 31 and a connecting bolt 32. The main difference lies in that the stator positive terminal 19, the carbon brush positive terminal 18, and the stator negative terminal 20 are moved close to the control unit 2 with little modification. Moreover, the first reel holder 3 does not need to be modified to fit the motor 1. For the specific structure, please refer to the accompanying drawings.

The connection structure is located above the rotatable reel 23. The control unit 2 is located above the connection structure and connected to the connection structure. The first electrical connection terminal is located on the same side as that of the control unit 2. In this embodiment, the connection structure includes a first connection rod 5 and a second connecting rod 6. The first connecting rod 5 and the second connecting rod 6 connect the first reel holder 3 and the second reel holder 4 into one piece, which is a conventional structure.

The present embodiment further includes a decorative shell 22. The decorative shell 22 is connected to the deceleration unit 24 to form an integral shape. The integral shape is bilaterally symmetrical or substantially bilaterally symmetrical with respect to the shape of the housing 8. The deceleration unit 24 adopts a planetary reduction mechanism which is the same as the prior art.

The housing 8 and decorative shell 22 both can be made of aluminum material.

The above descriptions are merely preferred embodiments of the present invention, and any equivalent changes or modifications derived from the configurations, features, and principles described in the scope of the patent application are included in the scope of the present application. For example, the structure of the contactor 7 shown in the drawings is taken as an example, rather than posing a limitation on the claims. Apparently, other contactors can also be used for the same purpose.

What is claimed is:

1. A winch, comprising:
a motor,
a first reel holder,
a second reel holder,
a connecting structure connecting the first reel holder and the second reel holder,
a rotatable reel and
a deceleration unit,
wherein
the motor is connected to the first reel holder,
the deceleration unit is connected to second reel holder,
a housing, connected to the first reel holder,
the motor is located inside the housing, and
the housing is provided with an open end which has a first cut out opening therein, where an end surface of the open end which has the first cut out opening is in contact with the first reel holder and an electrical terminal, to which a power supply of the motor is connected, is positioned within the first cut out opening.

2. The winch according to claim 1, wherein
the housing is a cylindrical housing, and
the end surface of the open end is attached to a side surface of the first reel holder provided on one side of the motor.

3. The winch according to claim 1, wherein
the housing is provided with reinforcing ribs along a circumferential direction,
a mounting hole is provided at a position where the first reel holder and one end of the reinforcing ribs are attached to each other,
the mounting hole is inserted into a connecting piece to connect to the connecting structure,
after the housing is attached to the first reel holder, the mounting hole is covered by one end of the reinforcing rib.

4. The winch according to claim 1, further comprising
a decorative shell,
wherein
the decorative shell is connected to the deceleration unit to form an integral shape,
the integral shape is bilaterally symmetrical or substantially bilaterally symmetrical with respect to the shape of the housing.

5. A winch, comprising
a motor,
a control unit,
a first reel holder,
a second reel holder,
a connecting structure connecting the first reel holder and the second reel holder,
a rotatable reel, and
a deceleration unit,
wherein
the motor is connected to the first reel holder,
the deceleration unit is connected to second reel holder;
the control unit comprises a contactor,
a housing, forming a chamber together with the first reel holder,
wherein the motor is located in the chamber;
the housing is provided with an open end which has a first cut out opening therein, where an end surface of the open end which has the first cut out opening is in contact with the first reel holder and a first electrical connection terminal, to which a power supply structure of the motor is connected, is positioned within the first cut out opening;
the power supply structure comprises the first electrical connection terminal electrically connected to the contactor,
the control unit is adjacent to the first electrical connection terminal, or the control unit extends toward the first electrical connection terminal to cover the first electrical connection terminal, and
the first electrical connection terminal is electrically connected to the contactor via a conductor.

6. The winch according to claim 5, wherein
a transition piece is provided on a circuit between the first electrical connection terminal and the contactor,
the first electrical connection terminal is electrically connected to the transition piece via a first conductor, and
the transition piece is electrically connected to the contactor via a second conductor.

7. The winch according to claim 5, wherein
the control unit comprises a mounting plate,
one end of the mounting plate extends outward;
a portion extending outward is adjacent to the first electrical connection terminal,
a transition piece is mounted on the portion extending outward,
the first electrical connection terminal is electrically connected to the transition piece via a first conductor,
the transition piece is electrically connected to the contactor via a second conductor.

8. The winch according to claim 7, further comprising
a cover,
wherein the cover is used for covering exposed portions of the first electrical connection terminal, the first conductor, the transition piece, and the second conductor.

9. The winch according to claim 5, wherein
the housing is a cylindrical housing with a closed end and the open end,
the end surface of the open end is attached to the first reel holder on a side surface located on one side of the motor;
the conductor extends into the first cut out opening and is electrically connected to the first electrical connection terminal.

10. The winch according to claim 5, wherein
the housing is provided with reinforcing ribs along the circumferential direction,
a mounting hole is provided at a position where the first reel holder and one end of the reinforcing ribs are attached to each other,
the mounting hole is inserted into a connecting piece to connect to the connecting structure,
after the housing is attached to the first reel holder, the mounting hole is covered by one end of the reinforcing rib.

11. The winch according to claim 5, wherein
the first electrical connection terminal comprises three terminals, including a carbon brush positive terminal, a stator positive terminal and a stator negative terminal,
the stator positive terminal, the carbon brush positive terminal, and the stator negative terminal are sequentially distributed along the circumferential direction of the motor, and
the carbon brush positive terminal is axially offset so that the three terminals are distributed along a triangle.

12. The winch according to claim 5, wherein the power supply structure comprises a carbon brush negative terminal, a second opening is formed in a bottom of the housing, a conductor of the carbon brush negative terminal electrically connected to a negative pole of the power supply structure goes in and out through the second opening.

13. The winch according to claim 5, wherein the connecting structure is located above the rotatable reel, the control unit is located above the connecting structure and connected to the connecting structure, and the first electrical connection terminal and the control unit are located on the same side.

14. The winch according to claim 5, further comprising a decorative shell, wherein the decorative shell is connected to the deceleration unit to form an integral shape, the integral shape is bilaterally symmetrical or substantially bilaterally symmetrical with respect to the shape of the housing.

* * * * *